United States Patent [19]

Meyer

[11] Patent Number: 4,480,571

[45] Date of Patent: Nov. 6, 1984

[54] OUTBOARD MOTOR AUXILIARY STEERING SYSTEM

[76] Inventor: Ralph F. Meyer, 8629 NW. 14 Ct., Miami, Fla. 33147

[21] Appl. No.: 454,435

[22] Filed: Dec. 29, 1982

[51] Int. Cl.[3] ..... B63H 25/02

[52] U.S. Cl. ..... 114/146; 440/53; 440/900; 74/544

[58] Field of Search ..... 403/393, 206, 208; 74/543, 544, 471 R, 30, 480 B; 114/144 R, 146; 440/53, 63, 900, 64; 16/112, 115

[56] References Cited

U.S. PATENT DOCUMENTS

| | | | |
|---|---|---|---|
| 793,753 | 7/1905 | Woodman | 403/206 |
| 1,818,951 | 8/1931 | Harrel et al. | 403/206 |
| 2,651,296 | 9/1953 | Irgens | 440/63 |

*Primary Examiner*—Sherman D. Basinger
*Assistant Examiner*—Edwin L. Swinehart
*Attorney, Agent, or Firm*—Malloy, John Cyril

[57] ABSTRACT

A supplementary steering assembly designed to be used in combination with an outboard motor when the primary steering assembly such as a cable and steering wheel system or an outboard motor hydraulic-type steering system become incapacitated. A mounting link fixedly attachable to a tiller arm of the outboard motor is configured for movable attachment to a steering arm extending outwardly from the motor and inwardly in an accessible position to one positioned within the boat and having sufficient length to provide enough leverage to overcome the accompanying torque present during the operation of relatively high powered outboard motors.

11 Claims, 4 Drawing Figures

OUTBOARD MOTOR AUXILIARY STEERING SYSTEM

BACKGROUND OF THE INVENTION

1. Field of the Invention

This invention relates to a supplementary steering assembly of the type used with an outboard motor and attachable thereto for lateral positioning thereof when the normal or primary steering assembly and/or throttling assembly becomes incapacitated.

2. Description of the Prior Art

The most common outboard steering systems on outboard motors of fifty horsepower and above, generally incorporate a cable system attachable by some means to a steering wheel or like member. The cable slides forward and backwards inside a metal sheath. This movement by the cable in turn pushes and pulls the outboard motor from side to side in order to steer the boat in the intended direction. A plastic sheath encases the steering cable and metal sheath for the purpose of protection by repelling moisture which would otherwise come in contact with the metallic inner workings of the cable system.

However, the plastic sheath eventually has a tendency to break down and crack when exposed to the ultra violet rays of sun. When such breakdown begins to occur, moisture is allowed to penetrate the outer metal sheath and the deterioration at this portion of the cable begins. The greatest strain on the cable of a cable steering system is due to foreign matter entering the end of the tilt tube. The tilt tube is well recognized in the industry as the tube structure on which the motor pivots forward. The solid ram, which is part of the steering cable assembly, is inserted through the tilt tube and slides forward and backward therethrough. As the steering cable ram is retracted, it brings moisture into the tilt tube. Moisture entering by this means comes in direct contact with the inner core cable. This results in the metal sheath and sliding cable beginning to deteriorate once so exposed.

A solidifying of the lubricant used on the steering cable ram occurs due to fine foreign granular material being carried with the spray, which occurs when the boat is underway, and is deposited onto the lubricant and intermixes therewith.

This granular material which consists of silts and in coastal regions, the addition of sea salt, is carried into the tilt tube when the steering ram is retracted. This forms a paste-like substance which, if allowed to solidify, binds the steering ram to the inner wall of the tilt tube. This conditon is a common occurrence if the steering system is allowed to stand unused for even the normal interval between boating excursions.

It is the force required to free the steering cable ram, which is often the cause of strand breakage of the strands of the steering cable. The degree of breakage is indeterminate, due to the steering being completely encased.

The steering system, due to this exercise, has been freed and therefore the planned boating excursion will take place. However, the remaining life of the cable is indeterminate.

If either the above conditions exist, increased force is placed on the cable because sliding of such cable frequently becomes more difficult. Such increased strain eventually causes a snapping of the cable and the rendering of the steering cable system useless. Such failure can occur even though the user or occupant of the boat checks the steering system prior to taking the boat out. Commonly such a failure and breakdown of the cable system steering assembly occurs when the boat is far from land or safe harbor.

Furthermore, when such failure occurs the occupant or individual in a boat will generally attempt to hold onto the engine housing and position it manually in the intended steering direction. However, at this point one soon realizes that an engine of fifty horsepower or greater developes such torque even at relatively low speeds, sufficient to enable the motor to pull away from any manual positioning thereof. Such developed torque will put the boat in a left-hand turn at a speed which is well under the plane speed. As the engine size increases from the fifty horsepower range to the V-Six engines, the magnitude of the torque increases to an awesome level. The end result is that the motor is highly unmanageable for the manual positioning technique as set forth above even at extremely low speeds. This of course puts the boater in great danger when the breakdown of a primary steering system occurs a great distance from safe harbor.

Similar problems develop when failure in the throttle cable system also develops. If an individual is alone in a boat incorporating an outboard motor that has such a throttle cable failure, it is impossible for him to steer the boat from the normally located control panel while at the same time regulating the speed of the engine which must occur directly on the engine itself. Accordingly, the conventional the primary steering system must be disconnected.

In the aforementioned situations where the primary steering assembly becomes incapacitated or otherwise must be disconnected, it is obviously necessary to provide some supplementary or auxiliary steering assembly. Such an assembly should be capable of attachment to an outboard motor in a manner which provides enough leverage for manual positioning of the outboard motor. This leverage is necessary to overcome the torque developed when high powered outboard motors run at a normal speed. Such an auxiliary steering assembly should be readily adaptable for attachment to any outboard motor regardless of manufacturer. Further, it should be lightweight, inexpensive to maintain and purchase and otherwise generally convenient to carry in the boat without taking up unnecesary room. The design of such a supplementary steering assembly should be such as to allow the occupant of a boat, with limited mechanical ability, to readily attach the supplementary steering assembly to the outboard motor in a prescribed manner.

SUMMARY OF THE INVENTION

This invention is directed towards a supplementary steering assembly which is designed to be used in combination with an outboard motor generally of the size of fifty horsepower or greater when the conventional or primary steering system becomes incapacitated or otherwise must be disconnected for operation of the outboard motor and steering of the attached boat. It should be noted that the subject supplementary steering assembly is not a primary alternative steering system to conventional systems on the market today. To the contrary, the subject structure is intended for use in "emergency" situations where the primary cable system becomes incapacitated or otherwise must be disconnected due to throttle cable failure or the like.

The subject supplementary steering assembly comprises a steering arm having a generally elongated configuration and a connecting link. The connecting link is fixedly attached to the tiller arm of the outboard motor and extends outwardly and upwardly therefrom for proper disposition to accomplish movable attachment to the tiller arm. This tiller arm is of sufficient length for interconnection to the connecting link and is positioned to extend towards the interior of the boat so as to povide proper leverage to overcome torque of the outboard motor when running at a normal speed.

The steering arm includes an attachment end having a generally S-shaped configuration which at least partially defines a hinge means. This hinge means is completed when attached to the distal end of the connecting link not attached to the outboard motor. More specifically two apertures are formed in separating relation to one another by separating partitions. The hinge means is formed and pivotal movement of the steering arm relative to the connecting link is accomplished by inserting the outermost end of the attachment and successively into the two integrally formed apertures in the distal end of the connecting link. The attachment end has a generally S-shaped configuration defined by two oppositely facing indentations.

The specific pivotal functioning of the hinge means and the attendant configuration allowing said pivotal movement is provided to prevent damage to the boat if and when the outboard motor strikes an object in the water causing it to pivot forward. In such event, the steering arm will pivot substantially vertically and in fact may become disengaged from the distal end of the connecting link so as to prevent serious damage to the handrails, splash wells and other fixed structure of the boat which are not collapsible. It should be obvious that if such pivotal action was not provided, the steering arm or other portions of the supplementary steering assembly would be forced into the boat's superstructure possibly causing serious damage.

Other structural features of the subject steering assembly include a ramped configuration of the steering arm in a generally curvilear and/or upwardly angled configuration. This aids in the upward movement of the steering arm when it comes into contact with the superstructure if the engine strikes some object and is caused to pivot forwardly.

BRIEF DESCRIPTION OF THE DRAWINGS

For a fuller understanding of the nature of the invention, reference should be had to the following detailed description taken in connection with the accompanying drawings, in which.

Similar reference characters refer to similar parts throughout the several views of the drawings.

DETAILED DESCRIPTION OF THE PREFERRED EMBODIMENT

Figure 1:
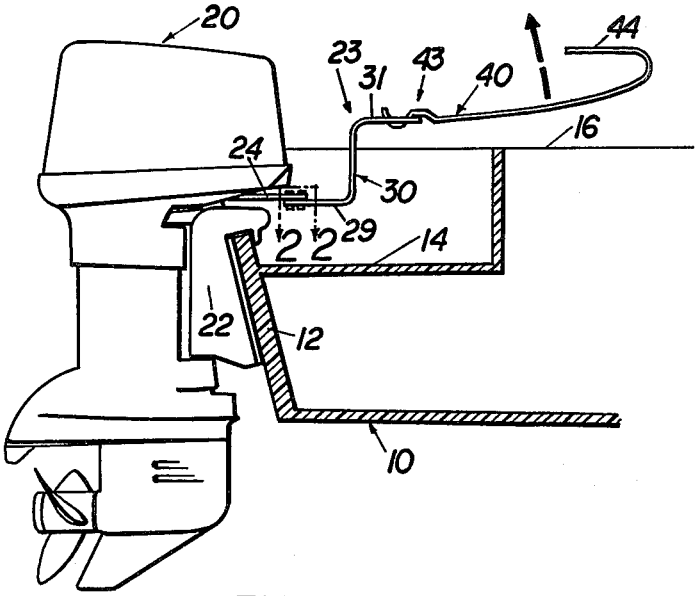
FIG. 1 is a side view in partial cross section showing an outboard motor with the subject invention attached thereto mounted on a conventional boat.
Figure 2:
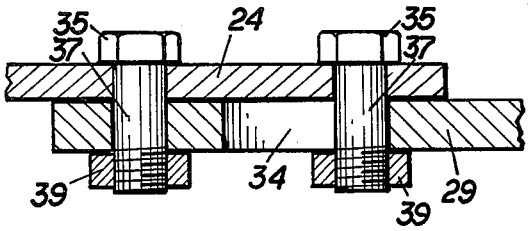
FIG. 2 is a sectional view taken along line 2—2 of FIG. 1.
Figure 3:
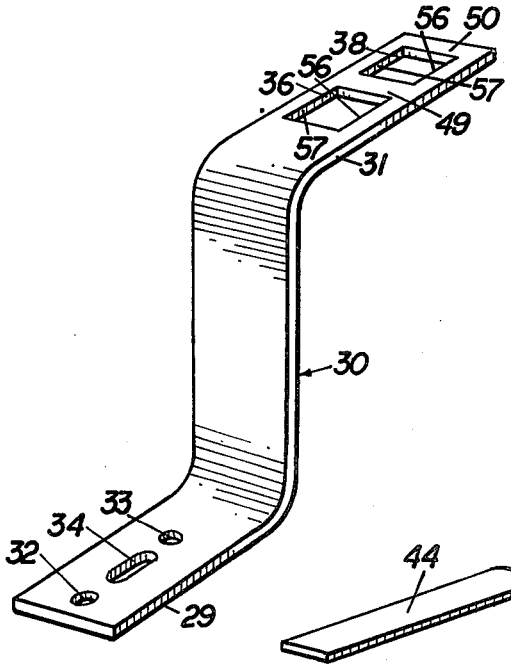
FIG. 3 is an isometric view of the connecting link of the present invention.
Figure 4:
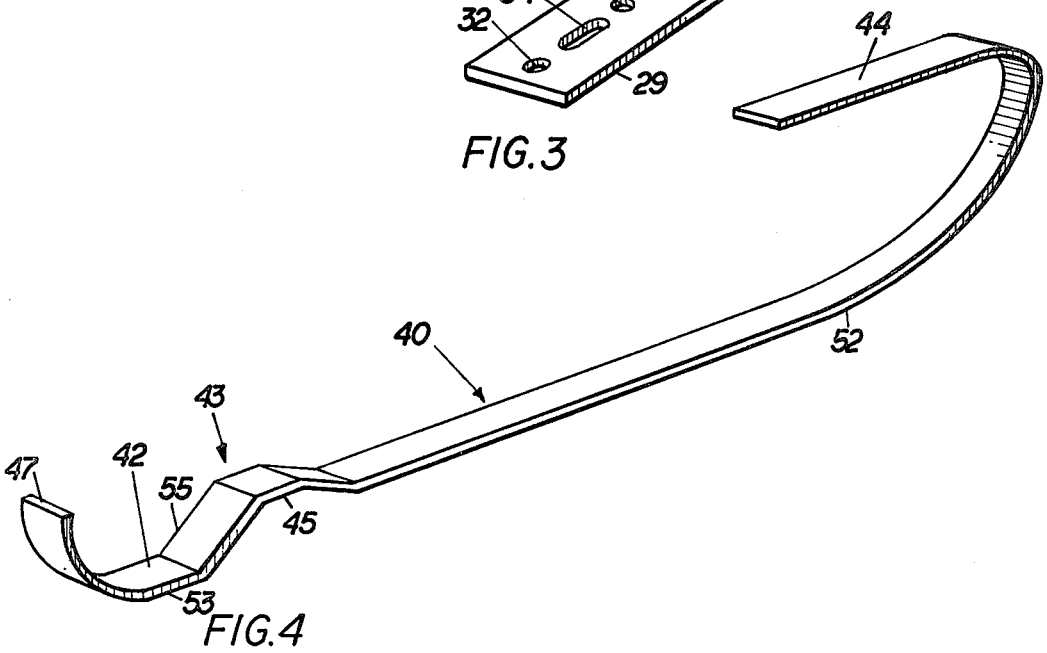
FIG. 4 is an isometric view of the steering arm portion of the present invention.

With reference to FIG. 1, the subject invention relates to the marine hardware industry wherein a boat 10 of conventional design has attached thereto an outboard motor 20. Mounting of the outboard 20 is accomplished by a conventionally structured mounting portion 22 attached to stern 12 of the boat. The mounting of motor 20 occurs immediately adjacent splash well 14 and is positioned in conventional orientation to the gunwale 16. The supplementary steering assembly of the present invention is generally indicated as 23 and includes a connecting link 30 having first and second finger elements 29 and 31 respectively. (See FIG. 3). The subject steering assembly 23 is connected to the motor by fixed attachement to tiller arm 24 which is a conventional part of outboard motors. More specifically, first finger element 29 includes spaced substantially round apertures 32 and 33 and an elongated aperture 34 disposed in spaced relation therebetween. With reference to FIG. 2, the first finger element 29 is attached to tiller arm 24 by hexagonal head cap screws 35 having their shafts 37 extending therethrough. Securing the connecting link 30 and more particularly the first finger element 29 to the tiller arm in the manner shown is accomplished by inserting the hexagonal head cap screws 35, preferably of $\frac{3}{8}$ inch by 24 threads per inch, through the two openings closest to the engine. In the embodiment shown, these openings are apertures 32 and oblong aperture 34.

The two frontmost apertures, 33 and 34, are utilized to accept hex head cap screws 35 due to the fact that some boat manufacturers which incorporate a splashwell into their design limit the transom height above that well. When in the event the outboard motor 20 pivots to its forwardmost position as if when striking an object beneath the surface, the tiller arm's outward tip is in close poximity to the splashwell. In this instance, the outboard motor tiller arm or the connecting link 30 is mounted closest to the engine in order to avoid contact with the splash well. This in turn prevents striking of the engine or tiller arm with the superstructure of the boat if and when it pivots forward. In this instance, the aperture 32 in the first finger element 29 is not used. However, it can readily be seen that depending on the particular design of the boat and/or motor, oblong aperture 34 and round aperture 32 can be used instead of aperture 33. In any event, connecting link 30 is fixedly attached to the tiller arm and moves therewith.

The steering arm generally indicated as 40 is attached to the connecting link 30 in a movable or pivotable fashion. This is due to the fact that the distal end generally indicated as 43 is the attachment end of the steering arm 40 and further defines a hinge means. This hinge means has a generally curvilinear or S-shaped configuration and is further defined by two oppositely facing indentations defined by inner surfaces 42 and 45. In the normal position of steering arm 40, the oppositely facing surfaces of indentations 42 and 45 rest or bear respectively on the undersurface of partition 49 and the upper or exposed surface of partition 50.

In actual operation, the attachment end 43 is connected to the second finger element 31 of connecting link 30 by successively passing the distal end 47 through apertures 38 and 36. The aperture means defined by the aforementioned apertures 36 and 38 further includes partitions 49 and 50 spaced apart from one another and generally spacing both apertures from the outermost end of the second finger element 31. As shown in FIG. 1, the attachment end of hinge means 43 is pivotally connected to move or pivot in a vertical direction if and when the outboard motor 20 is forced to pivot forwardly towards the interior of the boat. In this event, the undersurface of steering arm 40 as at 52 has a ramped or curvilinear configuration. This aids in forcing steering arm 40 into a counterclockwise or vertical movement (as shown in FIG. 1) of steering arm 40 and the movement of this arm relative to the connecting link 30. This prevents any serious damage to the superstructure in that the steering arm 40 will give way rather than be forced into the superstructure causing structural damage.

The end of the steering arm 40 is defined by handle element 44 which in turn is bent rearwardly toward the outboard motor and spaced above the ramped portion 52 of steering arm 40. This configuration is provided to additionally protect the hand of the operator when steering and when the steering arm is forced into engagement with the superstructure of the boat.

In addition, the dimension of the hinge means, generally indicated as 43, is such as to cause the outermost longitudinal edges 53 and 55 to bear against the inner peripheral edges 56 and 57 respectively causing lateral force to bear thereupon. This lateral force occurs of course when the steering arm is moved from side-to-side to cause proper positioning of the outboard motor 20 and overall steering performance of the boat 10.

What is claimed is:

1. A supplementary steering assembly for use in combination with a marine outboard motor, said steering assembly comprising:

(a) a steering arm connectable to the motor and positioned outwardly therefrom towards the interior of the boat on which the motor is mounted, (b) connecting means mounted on the motor and disposed in interconnecting relation between the motor and said steering arm, (c) said connecting means comprising a connecting link having opposite ends defined respectively by a first finger element and a second finger element each interconnected and extending outwardly in opposite directions from and in substantially transverse relation to a main body portion, (d) said first finger element attachable to the motor and said body portion having a sufficient length dimensioned to extend substantially above an upper portion of a splash well of the boat when said first finger element is so attached, (e) said second finger element comprising aperture means integrally formed therein and disposed and configured for mounting thereto of an attachment end of said steering arm, (f) said attachment end having its oppositely disposed lateral portions positioned in force-bearing engagement with inner lateral peripheral boundaries of said aperture means, whereby lateral movement of said steering arm causes lateral movement of said connecting link, and (g) said attachment end defining a hinge means positionable at least in part through said aperture means and having oppositely disposed surfaces disposed in force-bearing relation to upper and under surfaces of said second finger element, whereby said steering arm is pivotal on said connecting link in a vertical direction away from the boat.

2. A supplementary steering assembly as in claim 1 wherein said steering arm comprises a handle means disposed at the opposite end to said attachment end and in above spaced relation to the remainder of said steering arm when connected to the motor, said remainder of said arm having a ramped configuration at least in the general vicinity of said handle means.

3. A supplementary steering assembly as in claim 1 wherein said attachment end is configured to have its lateral, longitudinal edges disposed in force-bearing engagement with oppositely disposed, inner peripheral edges of said aperture means when said attachment end is disposed therethrough, whereby lateral positioning of the steering arm causes lateral positioning of the motor.

4. A supplementary steering assembly as in claim 1 wherein said first finger element comprises an upper surface and an undersurface each having a substantially flat, planar configuration and being disposed in substantially parallel relation to one another, each of said upper and under surfaces being further disposed and structured for independent, mating flush engagement with a correspondingly positioned mounting surface on the motor.

5. A supplementary steering assembly as in claim 4 wherein said first finger element comprises a plurality of mounting aperture means extending therethrough in communicating relation with both said upper surface and said undersurface, said upper and under surfaces substantially correspondingly dimensioned and disposed in contiguous and substantially surrounding relation to each of said plurality of mounting aperture means.

6. A supplementary steering assembly as in claim 5 wherein said plurality of mounting aperture means comprises a first aperture disposed in spaced relation from a leading distal edge of said first finger element and a second aperture spaced from said first aperture, said first and said second apertures each cooperatively disposed and configured relative to one another to insure a fixed engagement between said first finger element and a mounting surface of the motor.

7. A supplementary steering assembly as in claim 6 wherein said first aperture comprises a circular configuration and is disposed between said leading distal edge and said second aperture, said second aperture comprising an elongated configuration and oriented to have its longitudinal axis in substantially aligned relation with said first aperture.

8. A supplementary steering assembly as in claim 1 wherein said aperture means comprises at least two apertures separated from each other and an outermost edge of said distal end by spaced apart partitions, said attachment end having a curvilinear configuration extending successively through said two apertures and further including oppositely disposed indentations disposed in force-bearing relation to said partitions.

9. A supplementary steering assembly as in claim 8 wherein said curvilinear configuration comprises a substantially S-shaped configuration including oppositely facing indentations; the outermost edge of said attachment end extending successively through both said two apertures, said indentations disposed to have their respective interior surface portions bearing against opposite surfaces of respective ones of said partitions.

10. A supplementary steering assembly as in claim 9 wherein oppositely disposed longitudinal edges of each of said indentations bears against interior peripheral edges of respective ones of said two apertures, whereby lateral displacement of said steering arm causes lateral displacement of said connecting link and selective positioning of the motor during operation.

11. A supplementary steering assembly as in claim 9 wherein a distal end of said steering arm is slidingly positionable consecutively through both said two apertures and thereby removably attached to said mounting means.

* * * * *